United States Patent [19]

Mode

[11] 4,378,904

[45] Apr. 5, 1983

[54] COLLAPSIBLE OPEN SIDE CARTON

[75] Inventor: Duane R. Mode, Edina, Minn.

[73] Assignee: Champion International Corporation, Stamford, Conn.

[21] Appl. No.: 298,590

[22] Filed: Sep. 2, 1981

[51] Int. Cl.[3] ..... B65D 5/36

[52] U.S. Cl. ..... 229/41 B; 206/434

[58] Field of Search ..... 229/41 R, 41 B; 206/434

[56] References Cited

U.S. PATENT DOCUMENTS

| | | | |
|---|---|---|---|
| 3,005,584 | 10/1961 | Coe | 229/41 B |
| 3,572,577 | 3/1971 | Dorfman | 229/41 B |
| 3,931,888 | 1/1976 | Fogel | 206/434 |
| 4,037,721 | 7/1977 | Schillinger | 206/434 |
| 4,130,202 | 12/1978 | Champlin | 206/434 |
| 4,149,636 | 4/1979 | Pintsak | 206/434 |

*Primary Examiner*—Herbert F. Ross

*Attorney, Agent, or Firm*—Evelyn M. Sommer; William W. Jones; John H. Mulholland

[57] ABSTRACT

The carton is made from a one-piece blank which is erectable to an expanded condition from a flattened condition. The assembled carton is folded to the flattened condition at the point of manufacture for shipping to the point of filling. At the point of filling the flattened carton is expanded and the contents are placed in it. The carton has free end inwardly extending side wall panels which engage the end wall panels of the carton to hold the carton in the expanded condition.

4 Claims, 4 Drawing Figures

COLLAPSIBLE OPEN SIDE CARTON

This invention relates to a carton which can be transformed from an assembled flattened form to an expanded form for reception of contents to be contained therein.

The carton of this invention is formed from a one piece paperboard blank. When properly folded and glued the assembled carton can assume a flattened form which is suitable for bulk shipment from the point of manufacture to the point of filling. At the point of filling, the flattened form of the carton is expanded so as to be able to receive the contents packaged therein. The carton is provided with front and back panels, end panels, and side panels. The side panels are foldably connected to opposite edges of the back panel and are free of connection with the front and end panels. The side panels are folded into the interior of the carton in the flattened condition, and pivot upwardly, due to paperboard memory, when the carton is expanded so that the side panels engage the end panels to prevent the carton from collapsing back to the flattened form. A reinforcing tab is formed on the blank and extends between the front and back panels midway between the end panels so as to structurally strengthen the carton. The reinforcing tab is foldably connected to one of the front and back panels and adhesively secured to the other. The front and back panels provide for desirable graphics on the carton. A plurality of support tabs are struck from one of the end panels to provide means whereby the carton can be stood up on one of its end panels.

It is, therefore, an object of this invention to provide a paperboard carton which can be transformed from a flattened form to an expanded form.

It is an additional object of this invention to provide a carton of the character described having inwardly extending side panels operative to engage inner surfaces of the end panels of the carton to hold the latter in an expanded form.

It is another object of this invention to provide a carton of the character described which is formed from a one piece paperboard blank, and which, when folded and glued, can be transformed from a flattened shipping form to an expanded material-containing form.

These and other objects and advantages of this invention will become more readily apparent from the following detailed description of a preferred embodiment thereof taken in conjunction with the accompanying drawings, in which.

Figure 1:
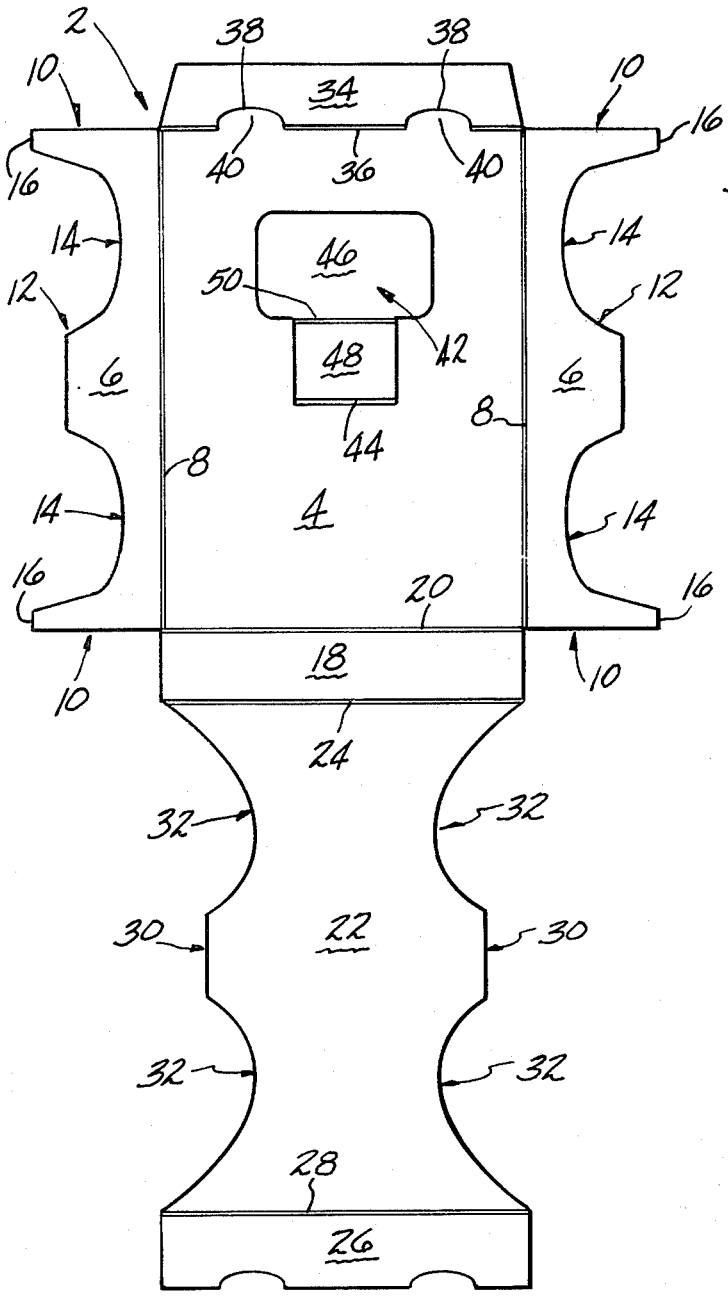
FIG. 1 is a plan view of a paperboard blank from which a preferred embodiment of the carton of this invention is formed.

Referring now to the drawings, there is shown in FIG. 1 a preferred embodiment of a paperboard blank, denoted generally by the numeral 2, from which a preferred embodiment of the carton of this invention is formed. The blank 2 includes a back panel 4 and a pair of side panels 6 hingedly connected to side edges of said back panel 4 by fold lines 8. The end edges 10 and the edges 12 opposite the fold lines 8 of the side panels 6 are free of connection with the remainder of the blank 2. The side panel edges 12 are provided with inwardly extending recesses 14. At the ends of the side panels 6 there are formed projecting retaining tabs 16. An end panel 18 is hingedly connected to the back panel 4 by means of a fold line 20 and a front panel 22 is hingedly connected to the end panel 18 by means of a fold line 24. An end panel-glue flap 26 is hingedly connected to the other end of the front panel 22 by means of a fold line 28. The side edges 30 of the front panel 22 are free of connection with the remainder of the blank 2 and are formed with inwardly extending recesses 32. A second end panel-glue flap 34 is hingedly connected to the free end of the back panel 4 by means of a fold line 36. A pair of curved cuts 38 extend through the fold line 36 into the panel 34 so as to form supporting feet 40 for the carton whereby the latter can be stood on end when in the expanded form. A reinforcement tab 42 is cut from the back panel 4 and is hingedly connected thereto by means of a fold line 44. The tab 42 is sub-divided into a glue flap 46 and a bridging portion 48 by means of a fold line 50.

Figure 2:
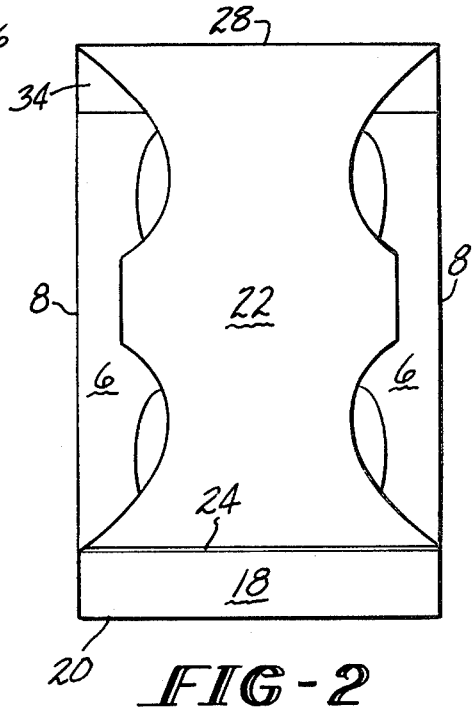
FIG. 2 is a top plan view of the carton formed from the blank of FIG. 1, which carton is shown in its flattened form.

To assemble the blank 2 into the flattened carton form shown in FIG. 2, the side panels 6 are folded about the fold lines 8 to overlie the back panel 4. Glue is applied to the end panel-glue flap 26 and to the glue-flap 46. The end panel 18 and front panel 22 are then folded about the fold line 20 to overlie the infolded side panels 6 and the back panel 4 and to adhesively secure the glue flap 46 to the inside of the front panel 22. The end panel-glue flap 26 is then folded about the fold line 28 against the end panel-glue flap 34 to adhesively secure the two end panel-glue flaps 26 and 34 together to form a compound end panel.

Figure 4:
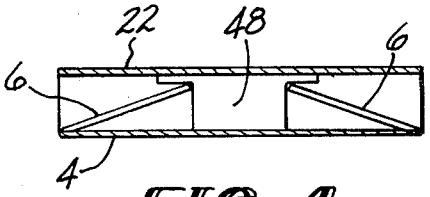
FIG. 4 is a cross-sectional view taken along line 4—4 of FIG. 3.
Figure 3:
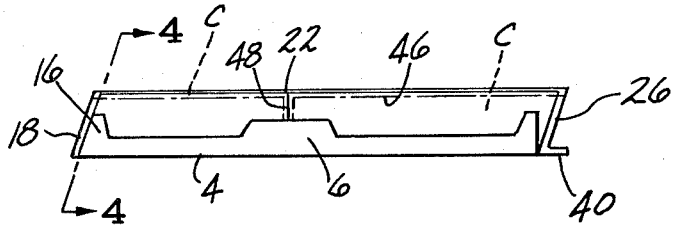
FIG. 3 is a side elevational view of the carton of FIG. 2 shown in its expanded form.

To expand the carton from the flattened form shown in FIG. 2 to the expanded form shown in FIGS. 3 and 4, the end panels 18 and 26, 34 are pressed toward each other while the front panel 22 is lifted away from the back panel 4. The carton thus expands about the fold lines 20, 24, 28 and 36. As the carton is thus expanded, the side panels 6 automatically spring upward to the degree shown in FIG. 4 due to the memory of the paperboard. When the side panels 6 are in the sprung position shown in FIGS. 3 and 4, the retaining tabs 16 on the side panels 6 engage the end panel 18 thereby preventing the carton from reassuming the flattened form, and holding it in the expanded form. The bridging portion 48 of the tab 42 lends internal strength to the mid portion of the carton and subdivides the interior of the carton into two equal parts. The particular carton shown herein is designed to contain two cylindrical containers of air freshener, with one container being disposed within the carton on each side of the bridge 48, the containers being shown in phantom in FIG. 3 inside the carton and denoted by the letter C. The recesses 14 in the side panels 6 engage the sides of the cylindrical containers C and assist in positioning and retaining the containers C properly within the carton. As noted from FIG. 3, the expanded carton assumes a slight parallelogram form, thus the supporting feet 40 are useful to enable the carton to be placed upright on the compound end panel 26, 34 if so desired.

It will be readily understood that the cylindrical containers C can be slid into the carton from one of the open sides and that the side panel 6 over which they are slid will spring back up to prevent the containers C from exiting through the open side through which they were inserted. Similarly, one or both of the containers C can be withdrawn from the carton by simply depressing a side panel 6 and sliding the container C out over the depressed side panel. If so desired, the bridge between the front and back panels can be formed as an extension on one of the compound end panels and folded back into the interior of the carton along the front or back panel and then folded across and secured to the other of the front or back panel.

It will be readily appreciated that the carton of this invention can be quickly formed from the blank to the flattened condition and can be quickly expanded and filled. The contents can be removed from the carton without mutilating the carton, simply by pressing one of the free side panels down to release the contents from engagement by that side panel, and then sliding the contents out over the depressed side panel.

Since many changes and variations of the disclosed embodiment of the invention may be made without departing from the inventive concept, it is not intended to limit the invention otherwise than as required by the appended claims.

What is claimed is:

1. A collapsible paperboard carton comprising:

(a) opposed front and back panels;

(b) opposed end panels foldably connected to opposite ends of said front and back panels; and (c) opposed side panels foldably connected to opposite sides of one of said front and back panels, said side panels being free of connection with said end panels and the other of said front and back panels, said side panels being folded inwardly into the confines of said carton in face-to-face engagement with said front and back panels when said carton is in a flattened collapsed form, and said side panels, due to the inherent springiness of the paperboard, being operable to swing to a position disposed at an acute angle with respect to said one of said front and back panels, when said carton is in an expanded form and at least one end edge of each of said side panels being disposed in engagement with at least one of said end panels to retain said carton in said expanded form.

2. The carton of claim 1 further comprising a bridging panel foldably connected to each of said front and back panels and extending between said front and back panels medially thereof, said bridging panel being substantially parallel to said end panels to strengthen the medial portion of said carton and to divide said carton in two adjacent compartments.

3. The carton of claim 1, wherein each of said side panels has a free side edge configured to positively engage articles disposed in said carton to retain said articles in said carton.

4. The carton of claim 1 wherein said front, back and end panels define an acute angle parallelogram when said carton is in said expanded form and further comprising support feet tabs cut from a fold line interconnecting one of said end panels with one of said front and back panels, said support feet tabs projecting beyond said fold line to provide means for supporting said carton upright on said one of said end panels.

* * * * *